US006161721A

United States Patent [19]

Kudera et al.

[11] Patent Number: 6,161,721

[45] Date of Patent: Dec. 19, 2000

[54] MEDICAMENT DISPENSING CELL WITH DUAL PLATENS

[75] Inventors: Keith W. Kudera, Merriam; Lawrence E. Guerra, Roeland Park, both of Kans.; Ronald A. Leonard, Peculiar, Mo.

[73] Assignee: Scriptpro LLC, Mission, Kans.

[21] Appl. No.: 09/256,658

[22] Filed: Feb. 23, 1999

[51] Int. Cl.[7] ..... G07F 11/00

[52] U.S. Cl. ..... 221/9; 221/277

[58] Field of Search ..... 221/2, 7, 9, 13, 221/15, 225, 226, 127, 206, 258, 277

[56] References Cited

U.S. PATENT DOCUMENTS

| | | | |
|---|---|---|---|
| 1,128,561 | 2/1915 | Webendorfer . | |
| 2,690,856 | 10/1954 | Trondle . | |
| 3,400,857 | 9/1968 | Schubert | 221/277 |
| 3,746,211 | 7/1973 | Burgess, Jr. . | |
| 4,284,301 | 8/1981 | Geiger et al. . | |
| 4,660,824 | 4/1987 | Hermkens et al. . | |
| 4,753,473 | 6/1988 | Arnett . | |
| 4,810,230 | 3/1989 | Shirasawa . | |
| 4,872,803 | 10/1989 | Asakawa . | |
| 4,902,263 | 2/1990 | Ito et al. . | |
| 5,033,785 | 7/1991 | Woolley, Jr. . | |
| 5,082,268 | 1/1992 | Santoro . | |
| 5,332,275 | 7/1994 | Conway et al. . | |
| 5,337,919 | 8/1994 | Spaulding et al. | 221/2 |
| 5,873,488 | 2/1999 | Guerra . | |

FOREIGN PATENT DOCUMENTS

| | | |
|---|---|---|
| 53-145260 | 12/1978 | Japan . |
| 59-43743A | 10/1984 | Japan . |
| 918086 | 4/1982 | Sudan . |

*Primary Examiner*—Kenneth Noland
*Attorney, Agent, or Firm*—Hovey, Williams, Timmons & Collins

[57] ABSTRACT

The preferred medicament dispensing cell (10) for use in an automatic dispensing machine (12) includes dual rotary platens (20,22). A storage platen (20) delivers medicament units (14) such as tablets and capsules from a storage section (86) to a discharge platen (22) in the discharge section (88) to deliver the units (14) to an outlet (50). In preferred forms, the platens (20,22) are sloped toward the respective peripheries in order to induce spreading of the units (14) into a single file for accurate counting during dispensing. The preferred embodiment also includes a discharge gate assembly (24) for receiving a medicament unit (14) in a gage chamber (108) to define the width of the discharge channel (110) leading to the outlet (50), and further includes an arcuate metering wall (26) shiftable into and out of the passage (84) between the storage and discharge sections (86,88) for metering medicament units (14) into the discharge section (88).

33 Claims, 9 Drawing Sheets

Fig. 20.
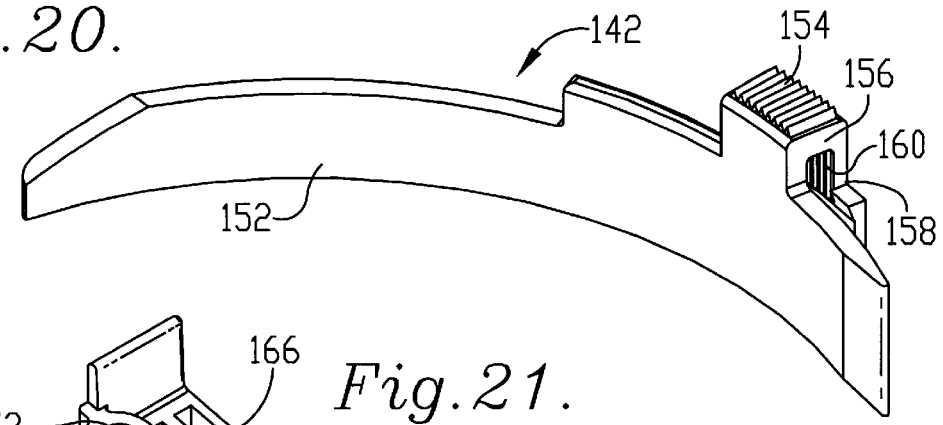
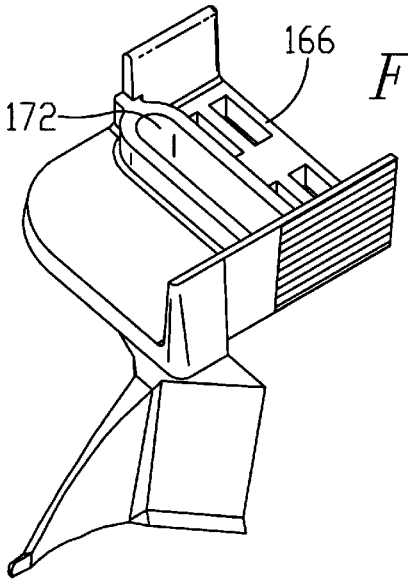
Fig. 21.
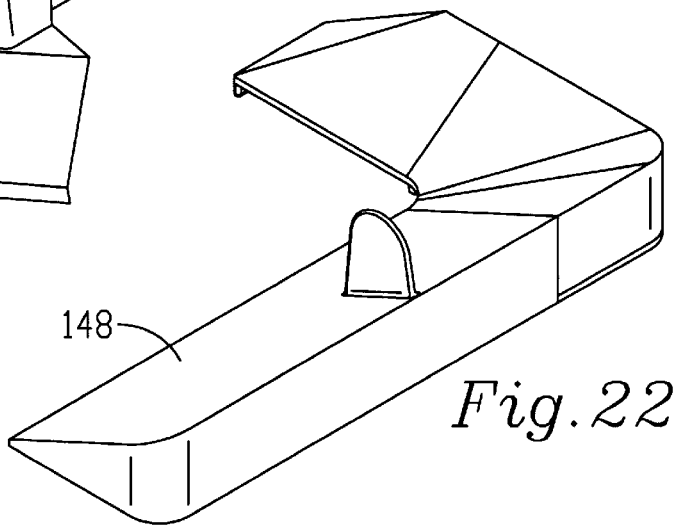
Fig. 22.
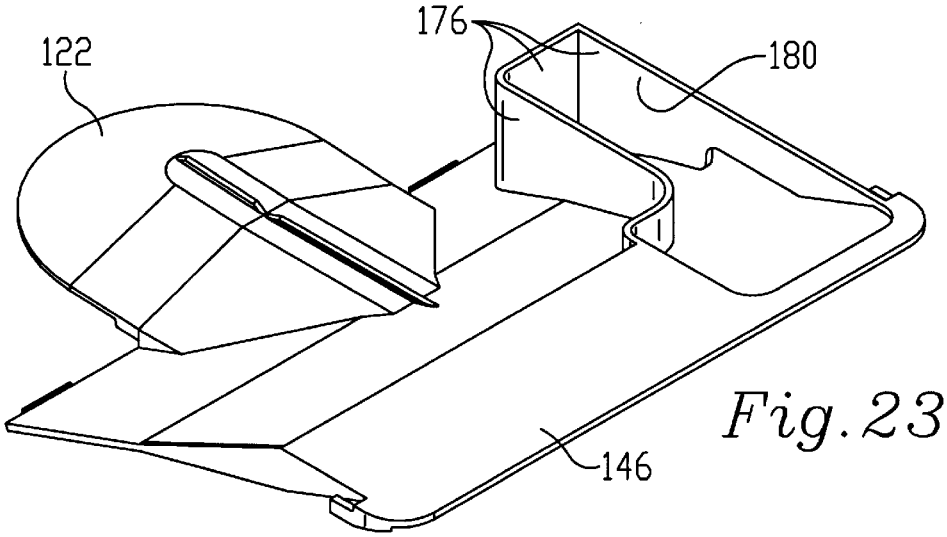
Fig. 23.

MEDICAMENT DISPENSING CELL WITH DUAL PLATENS

BACKGROUND OF THE INVENTION

1. Field of the Invention

The present invention relates to the field of automatic medicament dispensing machines. More particularly, the invention is concerned with a dispensing cell having dual platens for use in such a machine.

2. Description of the Prior Art

In the prior art, U.S. Pat. No. 5,337,919 discloses an automatic medicament dispensing machine having a plurality of dispensing cells for storing and dispensing respective medicaments such as tablets and capsules. Each cell includes a rotary platen in the discharge section. In operation, rotation of the platen dispenses medicament units from the cell to an outlet and into a vial. Other prior art cells also include a single rotary platen. While these prior art dispensing cells are generally acceptable, it is desirable to increase the dispensing rate, to increase the storage volume, to simplify adjustments, and to increase the accuracy in the count of dispensed units.

SUMMARY OF THE INVENTION

The present invention solves the problems discussed above and provides a distinct advance in the state of the art. More particularly, the dispensing cell with dual platens hereof provides for an increased rate of dispensing medicament units, simpler adjustments, increased storage volume, and increased accuracy in the count of dispensed units.

The preferred dispensing cell includes a rotatable storage platen in the storage section and a rotatable discharge platen in the discharge section with a passage between the sections. In operation, rotation of the storage platen delivers medicament units through the passage to the discharge platen for conveying units to the cell outlet. The preferred platens are sloped toward their respective peripheries for spreading medicament units into single file.

The preferred embodiment also includes a discharge gate assembly for receiving a medicament unit in a gage chamber to set the width of the discharge channel leading to the outlet. Preferred forms of the invention also includes an arcuate metering wall shiftable into and out of the passage between the storage and discharge sections for metering medicament units into the discharge section.

BRIEF DESCRIPTION OF THE DRAWINGS

FIG. 20 is a pictorial view of the metering wall of FIG. 16;

FIG. 21 is a pictorial view of the shiftable gate of FIG. 16;

FIG. 22 is a pictorial view of the discharge cover of FIG. 16;

FIG. 23 is a pictorial view of the storage shelf of FIG. 16;

DETAILED DESCRIPTION OF THE PREFERRED EMBODIMENT

Figure 1:
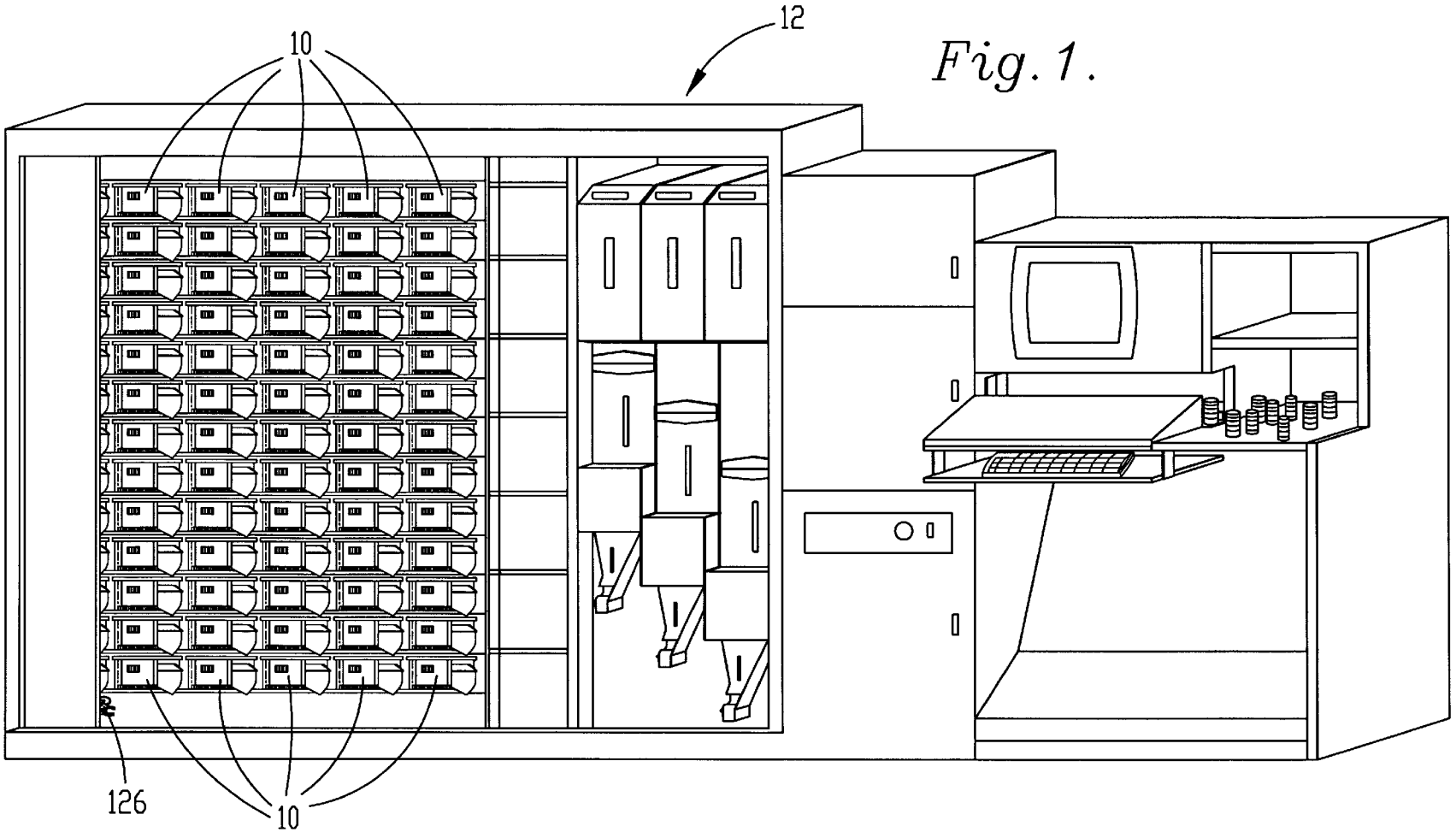
FIG. 1 is a pictorial view of an automatic medicament dispensing machine having a plurality of dispensing cells in accordance with the present invention.

FIG. 1 is a pictorial view illustrating a plurality of preferred dispensing cells 10 in accordance with the present invention shown in use in an automatic medicament dispensing machine 12 such as that disclosed in U.S. Pat. No. 5,337,919 hereby incorporated by reference as part of the disclosure hereof. Each cell 10 is used for dispensing medicament units 14 such as tablets and capsules. Referring to FIGS. 2–14 and, in particular, to FIG. 2, dispensing cell 10 includes housing 16, lid 18, storage platen 20, discharge platen 22, discharge gate assembly 24, metering wall 26 and storage shelf assembly 28.

As best viewed in FIGS. 4, 6, 7 and 9, housing 16 presents a generally rectangular configuration and includes circumscribing housing walls 30, apertured bottom wall 32, discharge wall 34, return wall 36, and tripod support structure 38 supporting hub 40. Housing walls 30 include left and right fits side walls 42 and 44, front wall 46 and back wall 48. Front wall 46 includes medicament unit outlet 50 adjacent the lower right corner thereof covered by hinged door 52. Side walls 42, 44 each present an outwardly extending lip 54 for slidably receiving and holding lid 18 as shown in FIGS. 2 and 3.

Bottom wall 32 includes front aperture 56 and rear aperture 58 defined therein. Tripod support structure 38 positions hub 40 centrally over front aperture 56. Discharge platen 22 is received through front aperture 56 from below and positioned for rotation about hub 40. Retaining screw 60 couples discharge platen 22 with hub 40.

Figures 8, 9, 10, 11, 12, 13, 14, 15:
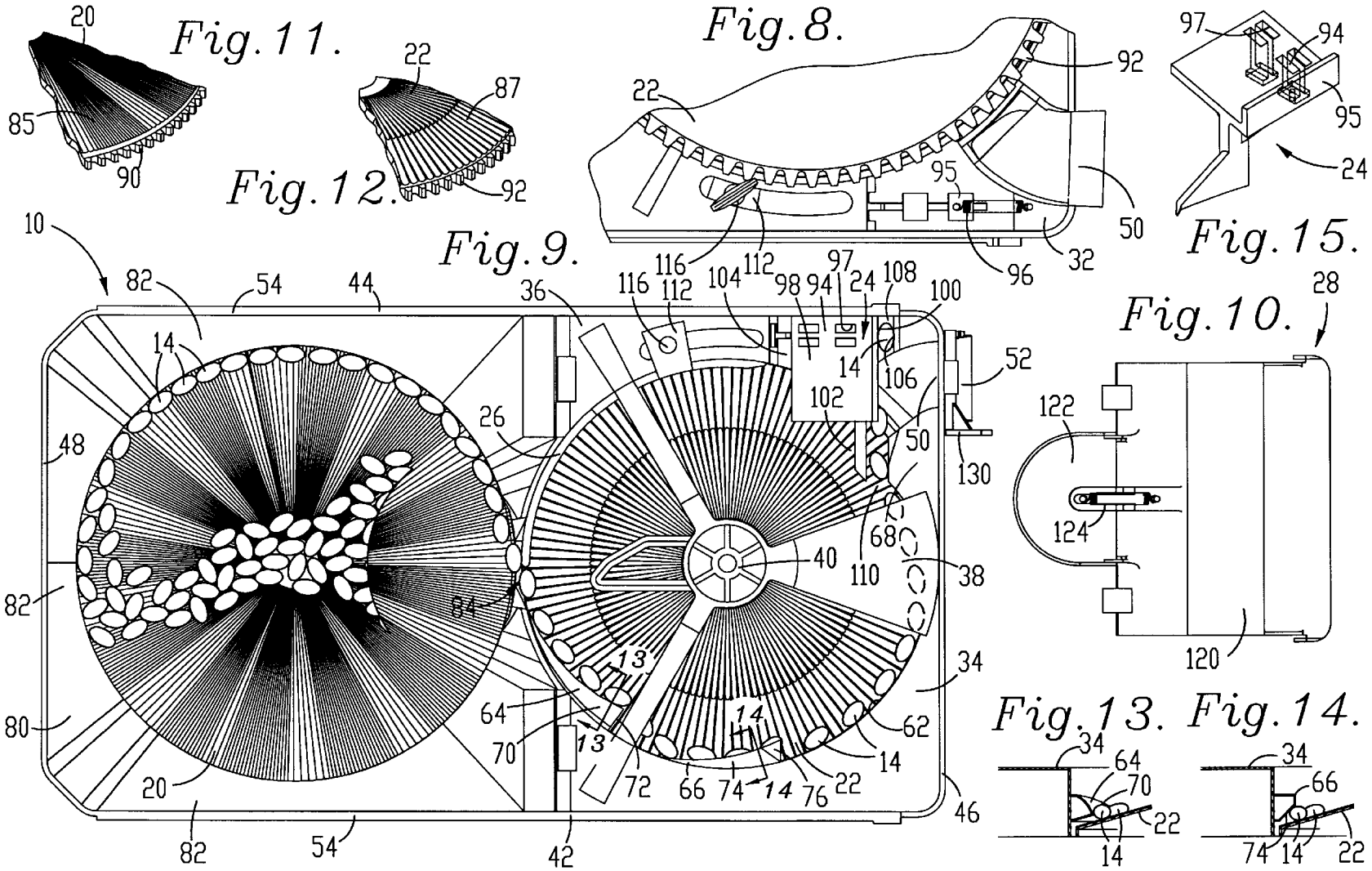
FIG. 8 is a partial, bottom plan view of a dispensing cell of FIG. 1.
FIG. 9 is a top plan view of a dispensing cell in FIG. 1 with the lid and storage shelf removed.
FIG. 10 is a top plan view of the storage shelf assembly of the preferred dispensing cell of FIG. 1.
FIG. 11 is a partial pictorial view of the preferred storage platen of the dispensing cell of FIG. 1.
FIG. 12 is a partial pictorial view of the preferred discharge platen of the dispensing cell of FIG. 1.
FIG. 13 is a sectional view taken along the line 13—13 of FIG. 9.
FIG. 14 is a sectional view taken along line 14—14 of FIG. 9.
FIG. 15 is a pictorial view of the gate assembly of FIG. 4.
Figure 16:
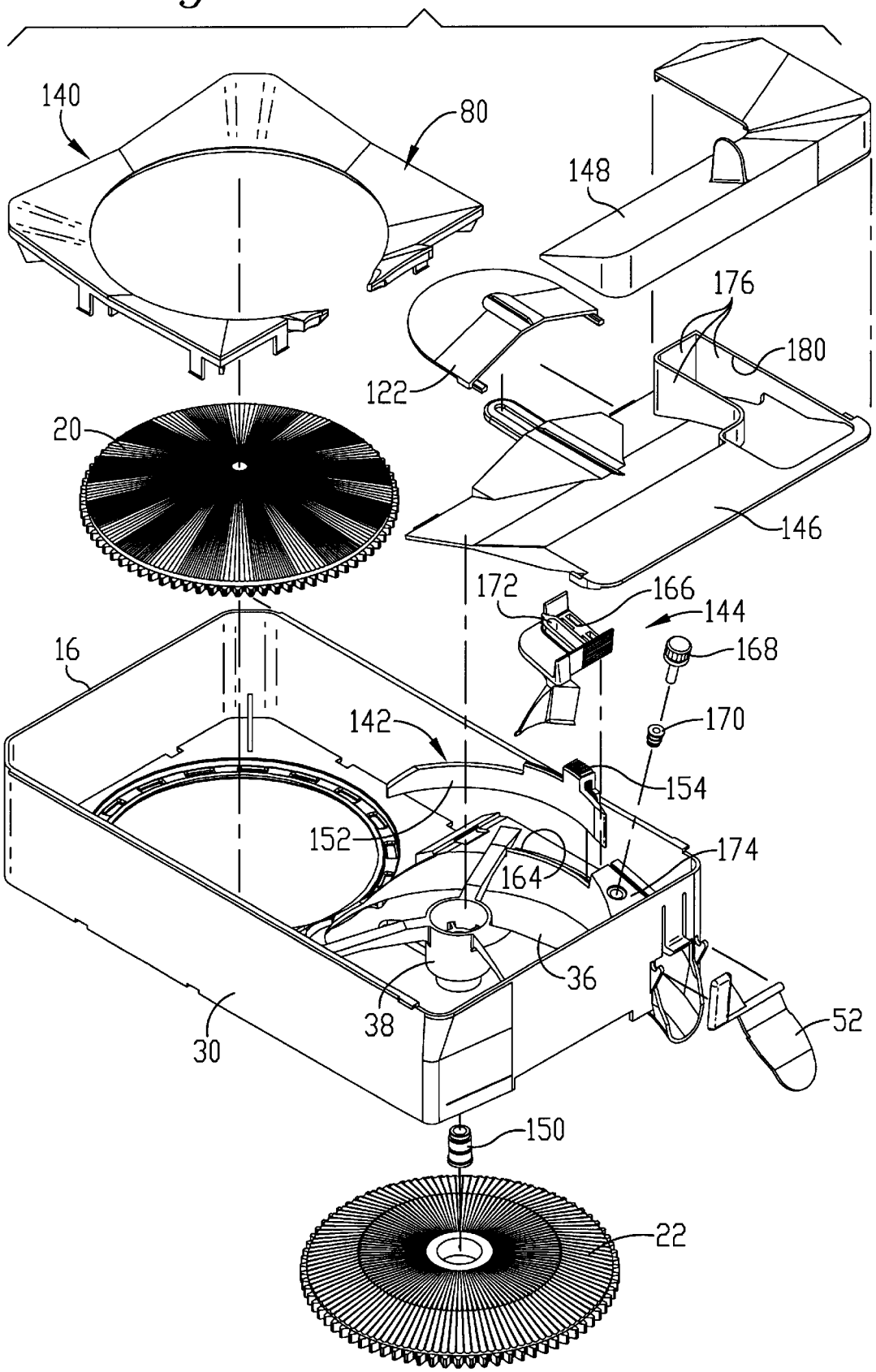
FIG. 16 is an exploded pictorial view of another embodiment of a dispensing cell in accordance with the present invention.
Figure 17:
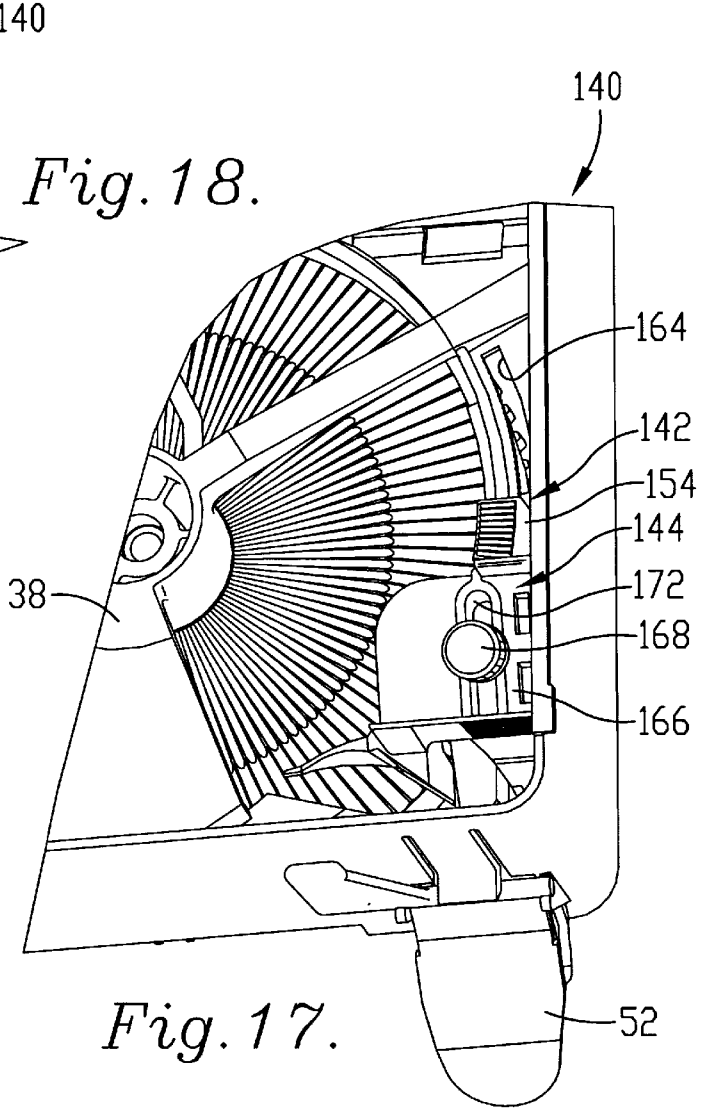
FIG. 17 is a partial plan view with the lid removed of the cell of FIG. 16 showing the gate assembly and metering wall.
Figure 18:
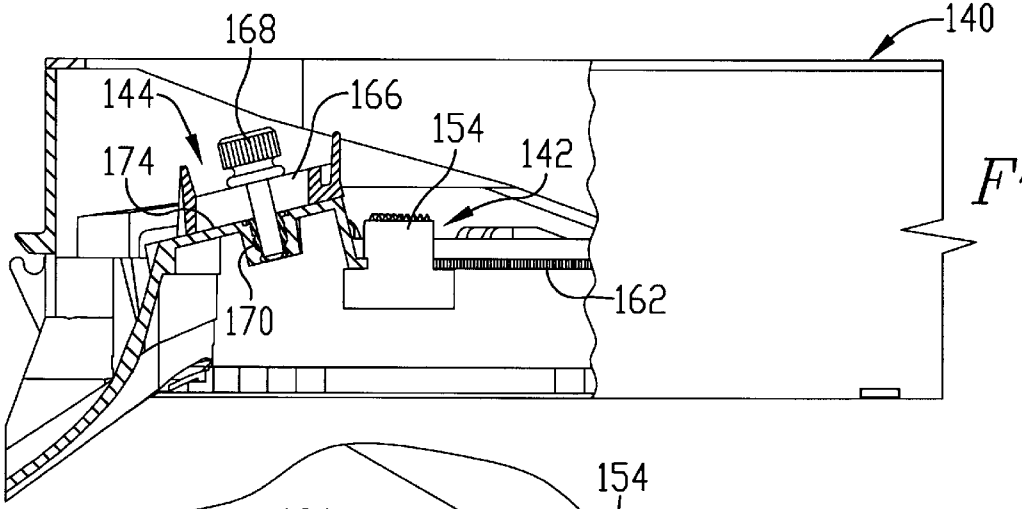
FIG. 18 is a side elevational view in partial section illustrating the gate assembly and metering wall of FIG. 17.
Figure 19:
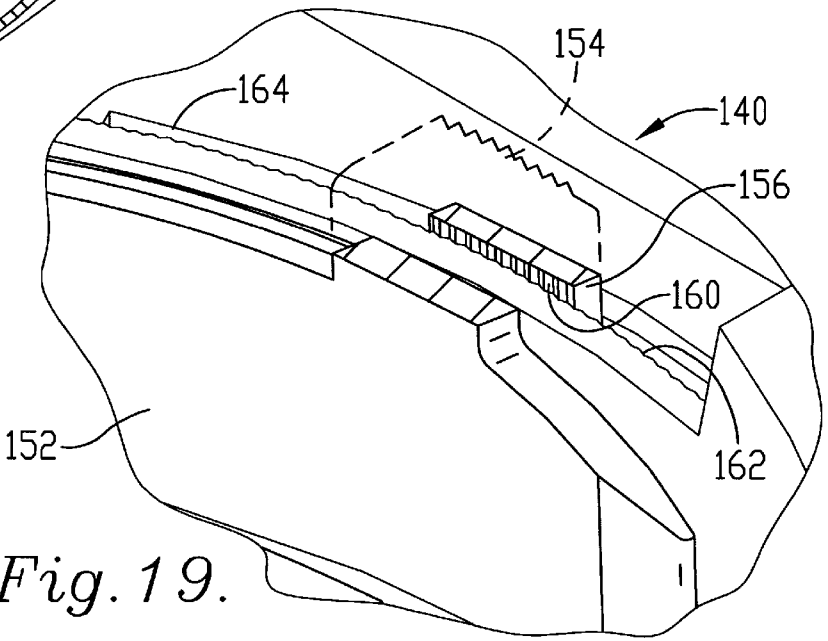
FIG. 19 is a partial pictorial view of the cell of FIG. 16 with portions cut away and portions in phantom lines illustrating the metering wall of FIG. 17.
Figure 24:
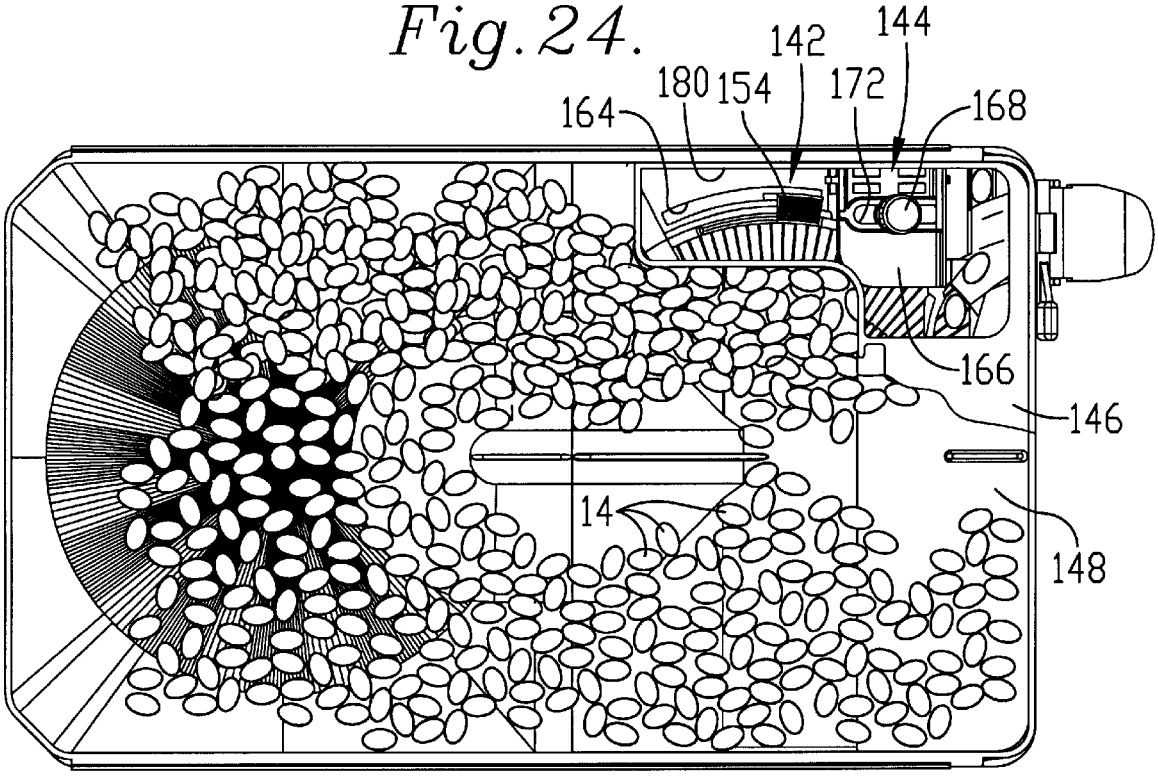
FIG. 24 is a plan view of the cell of FIG. 16 with the lid removed showing tablets stored therein and being discharged therefrom.
Figure 25:
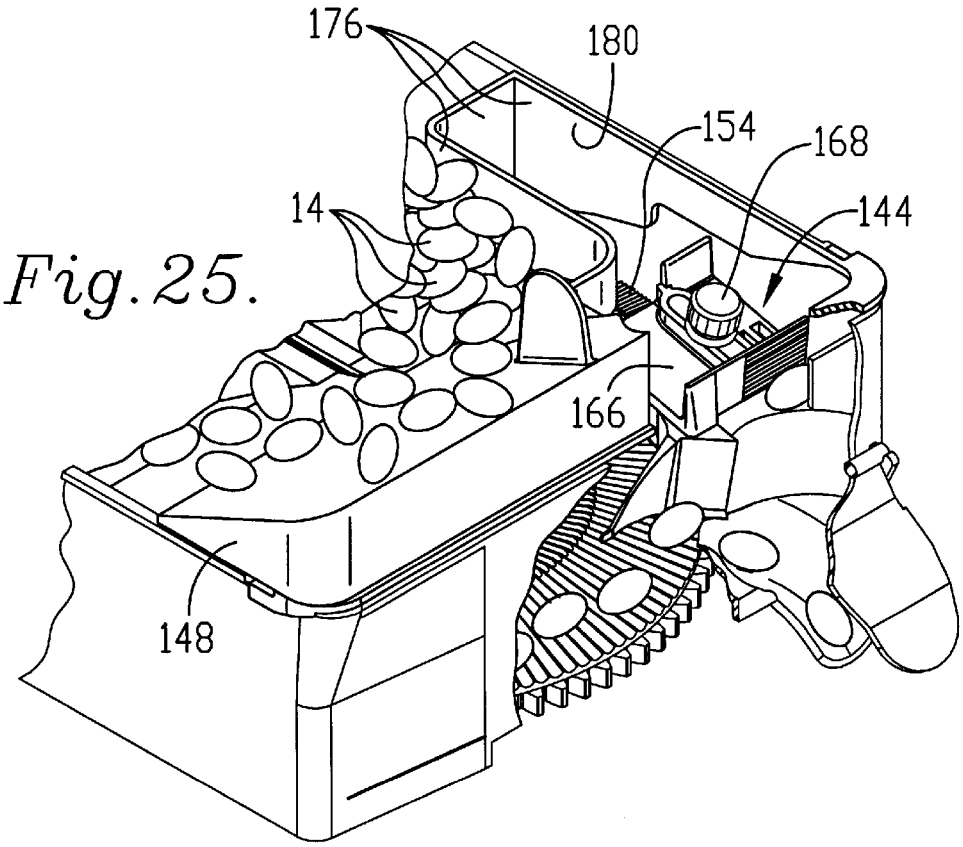
FIG. 25 is a partial pictorial view in partial section with portions cut away for clarity showing the discharge area of the cell of FIG. 16.

As best viewed in FIG. 9, discharge wall 34 extends inwardly from side wall 42 and front wall 46 adjacent discharge platen 22. Discharge wall 34 extends inwardly toward the periphery of discharge platen 22 to form juncture 62 therebetween.

Discharge wall 34 is also configured to present first and second spreading ramps 64 and 66 and outlet wall 68. First spreading ramp 64 presents an arcuate configuration and curves gradually inwardly from juncture 62 over discharge platen 22. Ramp 64 includes ramp wall 70 that slopes outwardly (FIG. 13) away from discharge platen 22 and terminates at end wall 72.

Similarly, second spreading ramp 66 presents an arcuate configuration and curves gradually inwardly from juncture 62 over discharge platen 22. Ramp 66 includes ramp wall 74 that tilts inwardly (FIG. 14) toward discharge platen 22 and terminates at end wall 76.

Outlet wall 68 also presents an arcuate configuration and curves gradually inwardly from juncture 62 over discharge platen 22. Outlet wall 68 is configured for guiding medicament units toward outlet 50.

Rear aperture 58 is configured to present a diameter slightly less than that of storage platen 20. In this way, the margin of storage platen 20 rotatably rests on rim 78 surrounding aperture 58.

As best viewed in FIG. 9, retainer 80 is positioned against the inboard surfaces of side walls 42, 44 and back wall 48 and is configured for retaining storage platen 20 rotatably on rim 78. Retainer 80 includes retainer walls 82 that slope inwardly from walls 42, 44 and 48 toward storage platen 20. Retainer walls 82 present a gap therebetween defining passage 84 between storage section 86, which is generally that portion of housing 16 defined by the periphery of retainer 80, and discharge section 88, which is generally that portion of housing 16 forward of passage 84.

Figures 2, 3, 4:
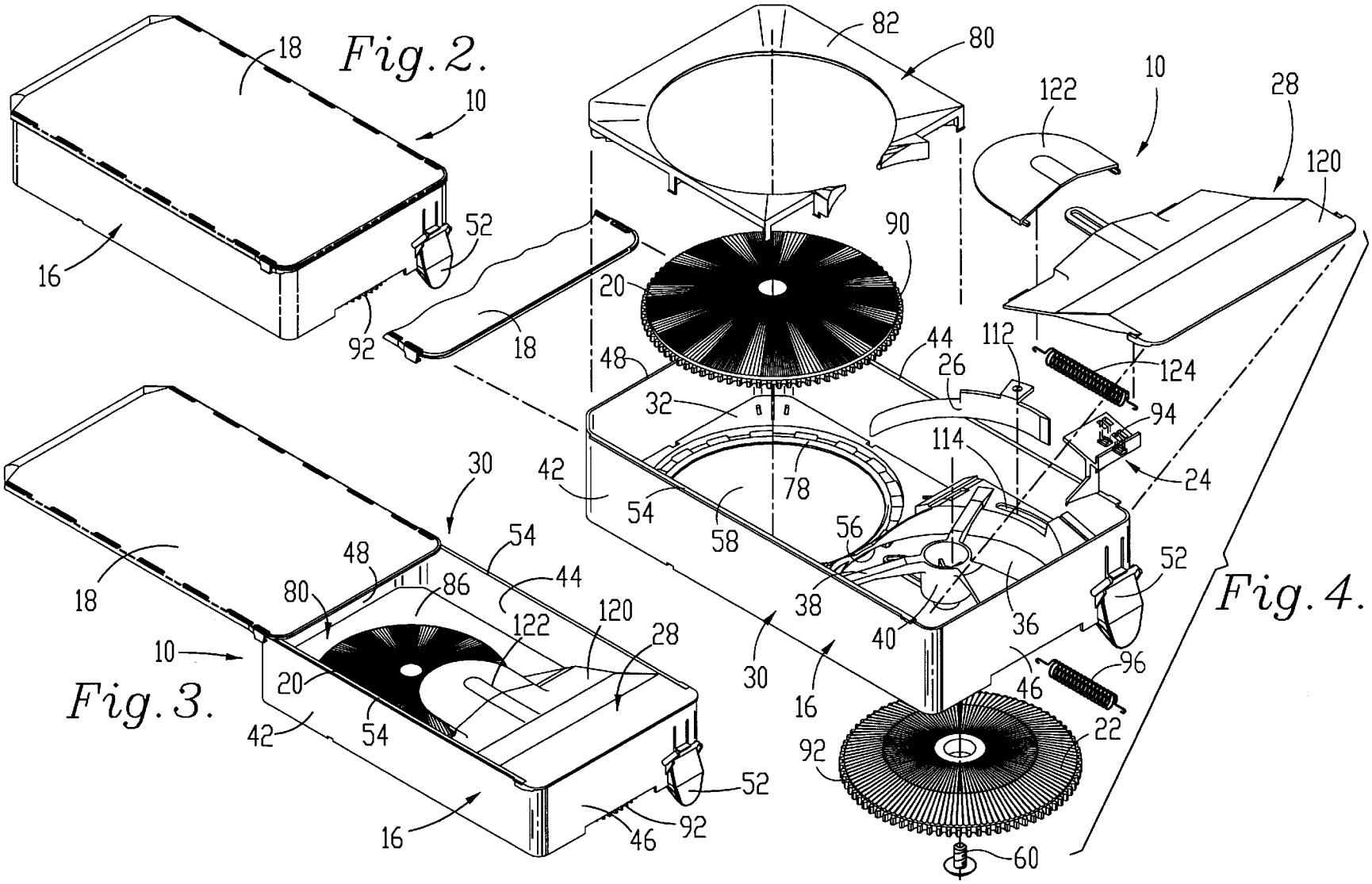
FIG. 2 is a pictorial view of a dispensing cell of FIG. 1 with the lid in the closed position.
FIG. 3 is a pictorial view similar to FIG. 2 but showing the lid in the open position.
FIG. 4 is a pictorial, partial, exploded view of a dispensing cell of FIG. 1.
Figures 5, 6, 7:
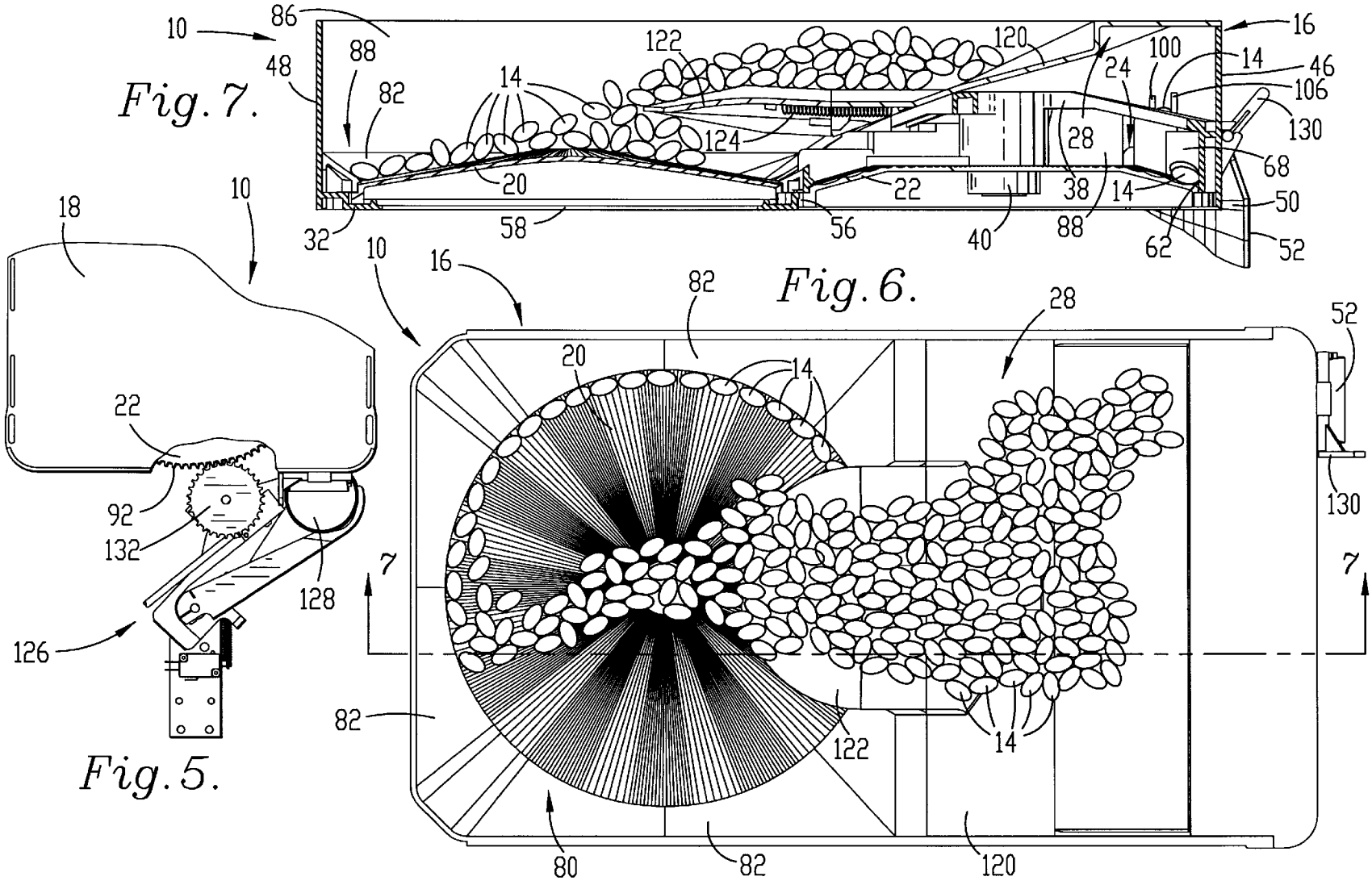
FIG. 5 is a partial plan view of the forward portion of a dispensing cell of FIG. 1 shown engaged for operation by a vial gripper mechanism of the dispensing machine.
FIG. 6 is a top plan view of a dispensing cell of FIG. 1 shown in operation with the lid removed.
FIG. 7 is a side elevational view in partial section of a dispensing cell of FIG. 1.

Referring to FIGS. 4, 7 and 11, storage platen 20 presents a generally conical configuration that slopes from the center toward the periphery. The upper surface of platen 20 includes texturing 85 in the nature of radially extending ridges and grooves defined in the upper surface thereof for gripping and conveying medicament units 14. Platen 20 also includes gear teeth 90 extending around the periphery thereof meshed with complementally configured gear teeth 92 extending around the periphery of discharge platen 22 for mutual rotation therewith.

As best viewed in FIGS. 4, 7 and 12, discharge platen 22 presents a generally dome-shaped configuration being somewhat flattened at the top and sloping more steeply than storage platen 20 toward the periphery thereof. Discharge platen 22 also includes texturing 87 in the nature of radially extending ridges and grooves defined in the upper surface thereof. As illustrated, the ridges and grooves present a greater spacing than those of storage platen 20 to increase the gripping capability.

Referring to FIGS. 4 and 9, discharge gate assembly 24 includes discharge gate 94 and spring 96. Discharge gate 94 includes top wall 98 presenting upturned gage wall 100 and triangularly shaped gate 102 extending from top wall 98. Top wall 98 presents upturned gage wall 100 and triangularly shaped gate 102 extending from top wall 98. Top wall 98 rests on slide wall 104 formed as part of housing return wall 36. Discharge gate 94 abuts side wall 44 and shifts on slide wall 104 toward and away from housing front wall 46.

Inserts 95 (FIG. 15) are received in slots 97 defined in top wall 98. Spring 96 (FIG. 6) interconnects inserts 95 and housing bottom wall 32 in order to bias discharge member 94 toward housing front wall 96.

Stop wall 106 (FIG. 6) extends from housing side wall 44 forward of gage wall 100 to define gage chamber 108 therebetween configured for receiving a medicament unit therein in order to set or gage the position of discharge gate 94 and thereby the position of gate 102 relative to outlet wall 68. Gate 102 and outlet wall 68 define discharge channel 110 therebetween.

The width of a medicament unit 14 received in chamber 108 determines the position of gate 102 and thereby determines the width of discharge channel 110. In particular, discharge gate 94 is configured so that the width of discharge channel 110 is greater than the narrowest width of a medicament unit received in chamber 108 but less than twice the width. This prevents entry of side by side medicament units into discharge channel 110 thereby improving the count accuracy and dispensing rate of dispensing cell 10.

Metering wall 26 presents an arcuate configuration generally matching the periphery of discharge platen 22. As shown in FIG. 9, metering wall 26 is configured to slide along and against return wall 36 adjacent the periphery of discharge platen 22 into and out of passage 84 in order to restrict the width thereof as needed. Metering wall 26 includes tab 112 extending over return wall 36 and over slot 114 defined therein. Thumb screw 116 is received through tab 112 and into slot 114 for locking metering wall 26 in a selected position.

Dispensing cell 10 also includes diverter 118 (FIG. 9) extending from hub 40 over the flat portion of discharge platen 22. Diverter 118 extends toward passage 84 and presents an angled face for diverting medicament units toward passage 84.

As best viewed in FIGS. 4, 7 and 10, storage shelf assembly 28 includes storage shelf 120, projecting shelf 122 extending rearwardly from storage shelf 120 and hingedly coupled therewith, and spring 124 interconnecting shelves 120 and 122. Referring to FIG. 7, storage shelf 120 is positioned generally over discharge section 88 and slopes toward storage section 86 with projecting shelf 122 extending over the passage 84. Shelf assembly 28 enables cell 10 to store additional units of medicament as compared to prior art cells. Projecting shelf 122 directs medicament units 14 generally toward the center of storage platen 20. In the event medicament units accumulate or jam under projecting shelf 122, the hinged coupling with storage shelf 120 allows projecting shelf 122 to shift upwardly in order to relieve the accumulation or jamming. Spring 124 biases back shelf 122 toward the level position as shown in FIG. 7.

In use, a selected dispensing cell 10 is removed from machine 12. Lid 18 is shifted to the open position as illustrated in FIGS. 3 and 6. Medicament units 14 are then placed in storage section 86. The configuration of cell 10 allows storage section 86 to be filled to the height of housing walls 30 including filling of the volume over storage shelf assembly 28.

Discharge gate 94 is then shifted leftwardly as viewed in FIG. 9. This allows one of the medicament units 14 to be placed in chamber 108 with the narrowest width thereof positioned between walls 100 and 106. Gate 94 is then released and shifts to the right under the bias of spring 96 until gage wall 100 encounters the medicament unit in chamber 108 against stop wall 106. This sets the width of discharge channel 110.

Next, thumb screw 116 is loosened to allow shifting of metering wall 26 as needed. In general, wall 26 is adjusted so that the width of passage 84 is greater than the largest dimension of medicament unit 14 but less than twice this dimension. Lid 18 is then shifted to the closed position as illustrated in FIG. 2 and cell 10 replaced in machine 12.

Machine 12 includes manipulator mechanism 126 as illustrated in FIG. 5. In operation, machine 12 operates mechanism 126 to retrieve a vial 128 and place the vial in position under outlet 50. The positioning of vial 128 engages door handle 130 which opens door 52 enabling the dispensing of medicament units from cell 10 into vial 128. Manipulator mechanism 126 includes a photoelectric eye for counting medicament units dispensed from cell 10.

Manipulator mechanism 126 also includes motor operated drive gear 132. In the dispensing position shown in FIG. 5, drive gear 132 engages gear teeth 92 of discharge platen 22.

To dispense medicament units, drive gear 132 rotates clockwise. This causes discharge platen 22 to rotate counterclockwise from the viewpoint of FIG. 9. The rotation of discharge platen 22 rotates storage platen 20 in the clockwise direction because of meshed gear teeth 90 and 92 of respective platens 20 and 22.

Referring to FIG. 9, the rotation of storage platen 20 conveys medicament units 14 from storage section 86 to discharge section 88 by way of passage 84. The sloped configuration of storage platen 20 and the surrounding retainer walls 82 induce medicament units 14 toward the periphery of storage platen 20. With metering wall 26 properly positioned, medicament units 14 generally pass through passage 84 in a single file. Excess medicament units 14 are carried past passage 84 and remain in storage section 86.

As medicament units 14 enter discharge section 88, discharge platen 22 receives units 14 on the textured surface thereof and conveys the units about the periphery. This is facilitated by the sloped configuration of the storage platen 20 and discharge wall 34. That is, these components induce medicament units toward juncture 62.

Upon entering discharge section 88, storage platen 20 conveys band medicament units 14 along first spreading ramp wall 70 that slopes outwardly. As the units reach end wall 72, they drop off along the slope of discharge platen 22 toward juncture 62. This action aids in dislodging stacked medicament units and in the spreading of the units into single file.

Medicament units next encounter second spreading ramp wall 74 that tilts inwardly. This also dislodges stacked medicament units 14 and further aids in arranging for single file and spaced conveyance along juncture 62.

As medicament units 14 continue along juncture 62, outlet wall 68 guides the units toward discharge channel 110. Because of the configuration of discharge platen 22, discharge channel 110 is sloped toward outlet 50. This spaces dispensed medicament units 14 for an accurate count by the photoelectric cell of manipulator mechanism 126. If any units remain in a side-by-side configuration, the width of discharge channel 1 10 prevents two units exiting side by side. As a result, gate 102 diverts excess units beyond discharge channel 110.

Discharge platen 22 conveys these diverted units along metering wall 26 toward passage 84. When a diverted unit passes by passage 84, the presence of the diverted unit inhibits the entry of another unit from storage section 86. This aids in preventing excess units from entering discharge section 88. If any medicament units 14 are located on the flat portion of discharge platen 22, diverter 118 diverts these units to the sloped portion of discharge platen 22 and toward passage 84. As medicament units are depleted from above storage platen 20, the slope of storage shelf assembly 28 directs any units stored thereabove into storage section 86 and thereby onto storage platen 20.

It will now be appreciated that dispensing cell 10 in accordance with the present invention substantially increases the dispensing rate, storage volume and counting accuracy of the dispensing cell and simplifies adjustments. Moreover, dispensing cell 10 is configured as an alternative to prior art dispensing cells. This allows cell 10 to be used in prior art dispensing machine 12 in combination with prior art dispensing cells.

SECOND EMBODIMENT

FIGS. 16–25 illustrate dispensing cell 140 as another embodiment in accordance with the present invention. Some components of cell 140 are similar to those of cell 10 and are numbered the same. In pertinent part, cell 140 includes metering slide 142, discharge gate assembly 144, storage shelf 146, shelf cover 148 and spindle bearing 150.

Referring to FIGS. 17–20 and 24–25, metering slide 142 is integrally composed of synthetic resin material and includes arcuate metering wall 152 and knob 154 presenting an inverted U-shaped configuration. Metering wall 152 is configured to slide along return wall 36 in a manner similar to metering wall 26 of dispensing cell 10 for selective metering of medicament units from storage section 36 to discharge section 88 by way of passage 84.

Knob 154 includes ridged upper section 156 for manual gripping and includes downwardly extending friction wall 158 spaced from metering wall 152 and having friction ridges 160 on the inboard surface thereof. As best viewed in FIG. 19, knob 154 is configured to snap over discharge wall 36 so that metering wall 152 is on one side thereof and friction wall 158 is on the opposed side. In this position, friction ridges 160 of friction wall 158 engage complementally configured friction ridges 162 defined on the outboard surface of discharge wall 34. Friction wall 158 slides in slot 164. With this configuration of metering slide 142, a user can grasp knob 154 and slide metering wall 152 to a selected position against the friction created by ridges 160 and 162. This friction between ridges 160 and 162 holds metering wall 152 in the selected position.

Referring to FIGS. 16–18, 21 and 24–25, discharge gate assembly 144 includes discharge gate 166, thumb screw 168 and bushing 170. Discharge gate 166 presents a configuration similar to that of discharge gate 94 and serves generally the same purpose of setting the width of the outlet passage. However, the embodiment of assembly 144 does not include a spring or the like biasing gate 94 toward the outlet wall. Rather, thumb screw 168 extends through slot 172 defined in the upper wall of gate 166. Bushing 170 is recessed into housing wall 174 and threadably receives the lower end of thumb screw 168. With screw 168 loosened, gate 166 can be shifted to a selected position along the length of slot 172. When gate 166 is in the selected position, thumb screw 168 is tightened. This action pulls gate 166 snugly against housing wall 174 to hold gate 166 in the selected position.

Spindle bearing 150 is partially received in hub 40. The central opening of discharge platen 22 is received over the exposed portion of bearing 150 and held in place by retaining screw 60.

Referring to FIGS. 16 and 23–25, storage shelf 146 is configured similar to storage shelf 120 of cell 10 but further includes barrier walls 176 defining access opening 180 enabling access to the components of metering slide 142 and discharge gate assembly 144 for adjustment thereof. More particularly, barrier walls 176 serve as a barrier to prevent entry of medicament units from storage section 86 into the vicinity of metering slide 142 and gate assembly 144. This provision eliminates the need to empty the dispensing cell of medicament units and remove the storage shelf in order to gain access to slide 142 and assembly 144 for adjustment thereof. Shelf cover 148 is configured to cover opening 180 and a portion of shelf 146.

Figure 26:
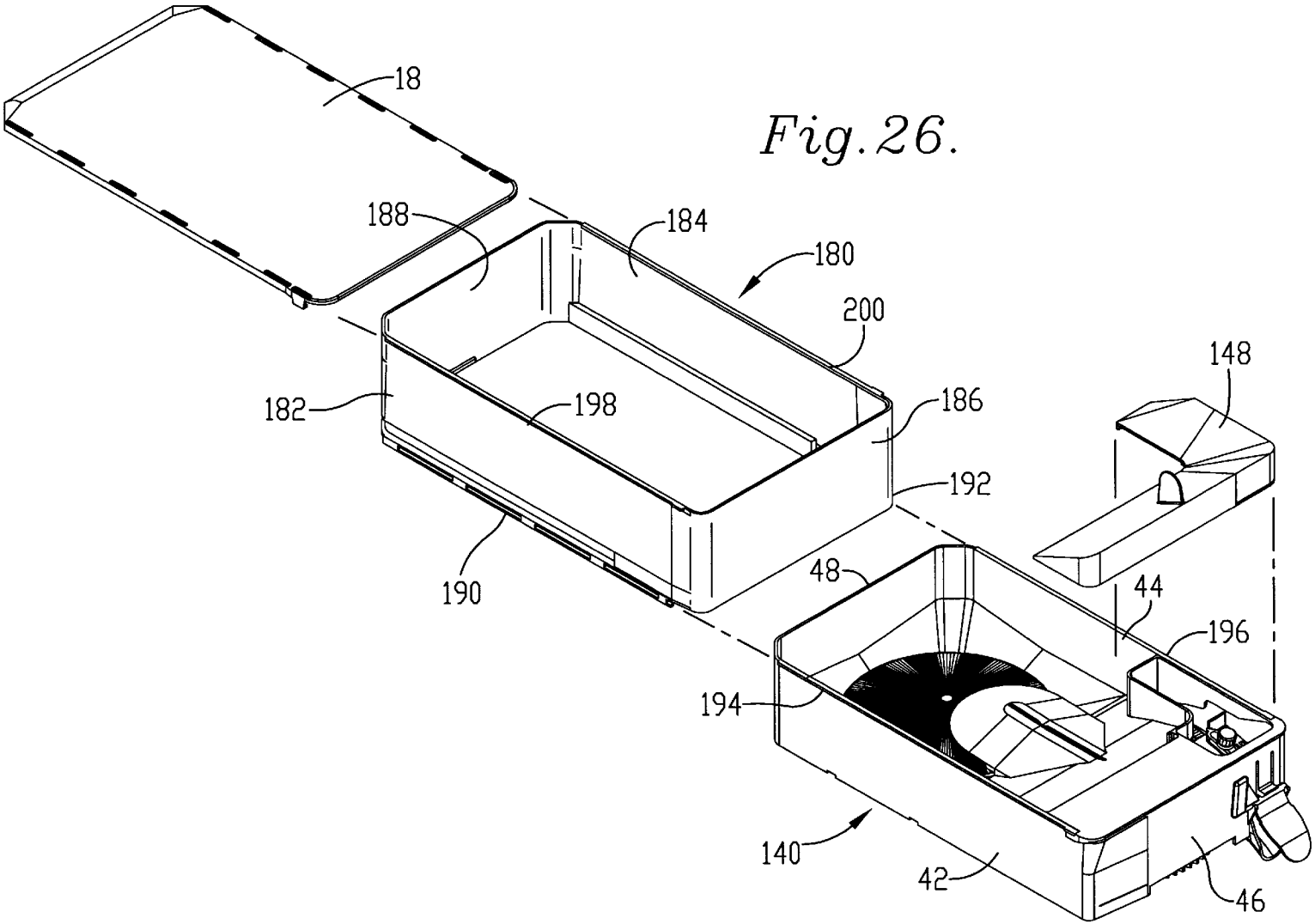
FIG. 26 is a pictorial view of a housing extension of the present invention shown in disassembled relationship to a dispensing cell, lid and storage shelf.

In another aspect of the present invention, FIG. 26 illustrates housing extension 182 configured for use with dispensing cells 10 and 140 and also for use with other types of dispensing cells including those of the prior art. In general, housing extension 182 can be coupled with a dispensing cell in order to extend the height of side walls thereof in order to increase the capacity to store medicament units of the storage compartment thereof.

Housing extension 182 is preferably composed of synthetic resin material and integrally includes extension walls 184, 186, 188 and 190 configured to abut and extend the side walls of a dispensing cell such as respective walls 42–48 of cells 10 and 140. The lower edges of extension side walls 182 and 184 include respective, outwardly extending coupling clips 192 and 194 configured to slide over respective flanges 196 and 198 of side walls 42 and 44 of a dispensing cell in order to couple extension 182 with the cell.

The upper edges of extension side walls 182 and 184 also include respective flanges 200 and 202 configured substantially the same as flanges 196 and 198 of the dispensing cell side walls. This enables lid 18 to couple with and cover housing extension 182. In the alternative, flanges 200 and 202 allow a second housing extension to be coupled therewith in order to further increase the storage capacity of the cell. Additional housing extensions can be added as needed.

Those skilled in the art will appreciate that the present invention encompasses many variations in the preferred embodiment described herein. For example, the preferred cell could be equipped or associated with its own drive mechanism without having to rely on the manipulator mechanism of the dispensing machine.

Having thus described the preferred embodiment, the following is claimed as new and desired to be secured by Letters Patent:

1. In an automatic medicament dispensing machine, a dispensing cell for dispensing units of medicament comprising:

a housing having walls configuring a storage section, a discharge section leading to an outlet, and a passage between said sections;

a rotatable storage platen forming at least a portion of the bottom wall of said storage section and operable during rotation to convey medicament units from said storage sections to said passage for delivery to said discharge section; and a rotatable discharge platen forming at least a portion of the bottom wall of said discharge section and configured for receiving medicament units from said storage section by way of said passage and operable during rotation to convey medicament units so received to said outlet thereby dispensing medicament units from said dispensing cell said discharge platen having a periphery, said housing including discharge walls adjacent a portion of said periphery with a juncture therebetween, said discharge platen being sloped toward said periphery for inducing medicament units toward said juncture during rotation of said discharge platen in order to induce spreading of said medicament units into single file along said juncture.

2. The dispensing cell of claim 1, said discharge platen presenting a dome-shaped configuration.

3. The dispensing cell of claim 1, said discharge walls including an arcuately shaped, first spreading wall gradually extending over a portion of said discharge platen and sloped outwardly therefrom in order to engage and spread medicament units being conveyed by said discharge platen.

4. The dispensing cell of claim 3, said discharge walls including an arcuately shaped, second spreading wall gradually extending over a portion of said discharge platen and sloped inwardly thereto from said juncture in order to engage and dislodge stacked medicament units being conveyed by said discharge platen.

5. The dispensing cell of claim 1, said discharge platen being rotatable about a stationary hub, said dispensing cell including a diverter extending radially from said hub toward said passage and adjacent said discharge platen for diverting medicament units conveyed beyond said outlet by said discharge platen toward said passage.

6. The dispensing cell of claim 1 further including a metering wall shiftably coupled with said housing and selectively shiftable into and out of said passage for selectively restricting the flow of medicament units therethrough.

7. The dispensing cell of claim 1, said metering wall including a plurality of friction ridges, said housing including friction ridges configured for complementally engaging the friction ridges of said metering wall for frictionally holding said metering wall in a selected position.

8. The dispensing cell of claim 7, said metering wall including a knob for manually grasping and shifting of said metering wall, said housing including barrier walls positioned between said storage section and said knob, and configured to define an access opening enabling access to said knob for adjustment thereof and to prevent entry of medicament units from said storage section into said access opening.

9. The dispensing cell of claim 6, said discharge platen having a periphery, said metering wall being arcuately shaped and slidable adjacent said periphery.

10. The dispensing cell of claim 1, said discharge platen having a periphery and being sloped toward said periphery.

11. The dispensing cell of claim 1, said discharge platen presenting a dome-shaped configuration.

12. The dispensing cell of claim 10, said discharge platen including radially extending texturing configured for providing gripping between said discharge platen and medicament units thereon.

13. The dispensing cell of claim 1, said storage platen having a periphery and being sloped toward said periphery.

14. The dispensing cell of claim 13, said storage platen presenting a conically shaped configuration.

15. The dispensing cell of claim 13, said storage platen including the radially extending texturing configured for providing gripping between said storage platen and medicament units thereon.

16. The dispensing cell of claim 1, said housing including a storage wall positioned over said discharge platen and sloped toward said storage platen for supporting medicament units stored in said dispensing cell.

17. The dispensing cell of claim 16, said housing further including a projecting shelf flexibly coupled with said storage wall and extending therefrom over said passage and over a portion of said storage platen.

18. The dispensing cell of claim 1, each of said platens including a periphery and a plurality of gear teeth define on the periphery of each of said platens with the gear teeth of said platens being intermeshed for synchronous rotation.

19. The dispensing cell of claim 1, each of said platens having the same diameter.

20. The dispensing cell of claim 1, said housing including storage section walls surrounding at least a portion of said storage platen and sloped toward said storage platen for directing medicament units positioned on said storage section walls toward said storage platen.

21. In an automatic medicament dispensing machine, a dispensing cell for dispensing units of medicament comprising:

a housing having walls configuring a storage section, a discharge section leading to an outlet, and a passage between said sections;

a rotatable storage platen forming at least a portion of the bottom wall of said storage section and operable during rotation to convey medicament units from said storage sections to said passage for delivery to said discharge section; and a rotatable discharge platen forming at least a portion of the bottom wall of said discharge section and configured for receiving medicament units from said storage section by way of said passage and operable during rotation to convey medicament units so received to said outlet thereby dispensing medicament units from said dispensing cell, said discharge platen having a periphery, said housing including discharge walls adjacent a portion of said periphery with a juncture therebetween, said discharge platen being sloped toward said periphery for inducing medicament units toward said juncture during rotation of said discharge platen in order to induce spreading of said medicament units into single file along said juncture, said housing including an outlet wall adjacent said outlet and including a stop wall, said dispensing cell further including a discharge gate assembly coupled with said housing and positioned adjacent said outlet, said gate assembly including a shiftable body having a gate shiftable relative to said outlet wall defining a discharge channel therebetween, and having a gage wall shiftable relative to said stop wall with a gage chamber therebetween, said chamber being configured for receiving a medicament unit therein, said gage wall being shiftable toward and away from said stop wall for engaging a medicament unit therebetween at a gage position, said gate being shiftable in registration with said gage wall to define the width of said discharge channel in correlation with the width of a medicament unit held in said chamber when said gage wall is in said gage position.

22. The dispensing cell of claim 21, said housing including barrier walls positioned between said storage section and said gate assembly, and configured to define an access opening enabling access to said gate assembly for adjustment thereof and to prevent entry of medicament units from said storage section into said access opening.

23. The dispensing cell of claim 21, said gate assembly including a spring biasing said gage wall toward said stop wall.

24. The dispensing cell of claim 21, said shiftable body including a thumb screw operable to hold said shiftable body in a selected position relative to said outlet wall.

25. The dispensing cell of claim 21, said outlet wall extending inwardly from said periphery.

26. In an automatic medicament dispensing machine, a dispensing cell for dispensing units of medicament comprising:

a housing having walls configuring a storage section, a discharge section leading to an outlet, and a passage between said sections; and a rotatable discharge platen forming at least a portion of the bottom wall of said discharge section and configured for receiving medicament units from said storage section by way of said passage and operable during rotation to convey medicament units so received to said outlet thereby dispensing medicament units from said dispensing cell, said discharge platen having a periphery, said housing including discharge walls adjacent to portion of said periphery with a juncture therebetween, said discharge platen being sloped toward said periphery for inducing medicament units toward said juncture during rotation of said discharge platen in order to induce spreading of said medicament units into a single file along said juncture.

27. The dispensing cell of claim 26, said discharge platen presenting a dome-shaped configuration.

28. In an automatic medicament dispensing machine, a dispensing cell for dispensing units of medicament comprising:

a housing having walls configuring a storage section, a discharge section leading to an outlet, and a passage between said sections, said housing including an outlet wall adjacent said outlet and including a stop wall;

a rotatable discharge platen forming at least a portion of the bottom wall of said discharge section and configured for receiving medicament units from said storage section by way of said passage and operable during rotation to convey medicament units so received to said outlet thereby dispensing medicament units from said dispensing cell; and a discharge gate assembly coupled with said housing and positioned adjacent said outlet, said gate assembly including a shiftable body having a gate shiftable relative to said outlet wall defining a discharge channel therebetween, and having a gage wall shiftable relative to said stop wall with a gage chamber therebetween, said chamber being configured for receiving a medicament unit therein, said gage wall being shiftable toward said stop wall for engaging a medicament unit therebetween at a gage position, said gate being shiftable in registration with said gage wall to define the width of said discharge channel in correlation with the width of a medicament unit held in said chamber when said gage wall is in said gage position.

29. In an automatic medicament dispensing machine, a dispensing cell for dispensing units of medicament comprising:

a housing having walls configuring a storage section, a discharge section leading to an outlet, and a passage between said sections; and a rotatable discharge platen forming at least a portion of the bottom wall of said discharge section and configured for receiving medicament units from said storage section by way of said passage and operable during rotation to convey medicament units so received to said outlet thereby dispensing medicament units from said dispensing cell; and a metering wall shiftably coupled with said housing and selectively shiftable into and out of said passage in order to selectively restrict the flow of medicament units therethrough, said discharge platen having a periphery, said metering wall being arcuately shaped and slidable adjacent said periphery.

30. In an automatic medicament dispensing machine, a dispensing cell for dispensing units of medicament comprising:

a housing having a plurality of walls including a plurality of circumscribing housing side walls defining a storage compartment configured to store medicament units, said housing including an outlet;

a dispensing mechanism coupled with said housing an operable to receive medicament units from said storage section and to dispense medicament units so received through said outlet; and a housing extension including a plurality of extension walls configured to make and couple with said housing side walls in order to extend the height thereof and thereby to increase storage capacity of said storage compartment.

31. The dispensing cell of claim 30, said housing extension being a first housing extension, said dispensing cell including a second housing extension configured to make and couple with said first housing extension in order to extend the height thereof and thereby increase further increase the storage capacity of said compartment.

32. The dispensing cell of claim 30, said housing side walls including a pair of opposed side walls having respective coupling lips, said housing extension including opposed extension side walls having respective clips configured for reception over said coupling lips in order to couple said housing extension with said housing side walls.

33. The dispensing cell of claim 32, said opposed side walls and respective coupling lips being integrally formed of synthetic resin material, said opposed extension side walls and clips being integrally formed of synthetic resin material.

* * * * *